US009915129B2

(12) United States Patent
Newell et al.

(10) Patent No.: US 9,915,129 B2
(45) Date of Patent: Mar. 13, 2018

(54) DUAL METHOD SUBSEA CHEMICAL DELIVERY AND PRESSURE BOOSTING

(71) Applicant: Oceaneering International, Inc., Houston, TX (US)

(72) Inventors: Todd Newell, The Woodlands, TX (US); Michael Cunningham, Richards, TX (US); Christopher Leon, Cypress, TX (US); Benjamin Primm, Houston, TX (US)

(73) Assignee: OCEANEERING INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/475,126

(22) Filed: Mar. 30, 2017

(65) Prior Publication Data

US 2017/0284173 A1 Oct. 5, 2017

Related U.S. Application Data

(60) Provisional application No. 62/315,417, filed on Mar. 30, 2016.

(51) Int. Cl.

| | |
|---|---|
| ***E21B 33/076*** | (2006.01) |
| ***E21B 41/00*** | (2006.01) |
| ***E21B 34/00*** | (2006.01) |

(52) U.S. Cl.

CPC ..... *E21B 41/0007* (2013.01); *E21B 34/00* (2013.01)

(58) Field of Classification Search

CPC .... E21B 33/076; E21B 34/00; E21B 41/0007; E21B 43/16

See application file for complete search history.

(56) References Cited

U.S. PATENT DOCUMENTS

| | | | | |
|---|---|---|---|---|
| 8,376,050 | B2 * | 2/2013 | Cumming | E21B 37/06 166/250.01 |
| 9,187,980 | B2 * | 11/2015 | McHugh | E21B 33/076 |
| 9,309,750 | B2 * | 4/2016 | Coonrod | E21B 33/068 |
| 9,328,872 | B2 * | 5/2016 | August | E21B 37/06 |
| 9,528,350 | B2 * | 12/2016 | Lunde | C02F 1/686 |
| 2006/0083624 | A1 * | 4/2006 | Cunningham | E21B 33/0355 417/53 |
| 2006/0243670 | A1 * | 11/2006 | Pinchin | C02F 1/688 210/748.11 |
| 2010/0074776 | A1 * | 3/2010 | Ludlow | F04B 5/00 417/415 |

(Continued)

*Primary Examiner* — Matthew R Buck

(74) *Attorney, Agent, or Firm* — Maze IP Law, PC

(57) ABSTRACT

A modular subsea chemical injection system, comprising a power and communications module, a power and communications umbilical terminator, a power and communications module, a fluid storage module comprising a plurality of fluid storage bays adapted to selectively receive a corresponding plurality of high and/or low flow fluid storage units, a pump module comprising a plurality of pump bays adapted to selectively receive a corresponding plurality of high fluid flow and/or low fluid flow pumps, and a fluid distribution unit in fluid communication with a pump module fluid port can be disposed on a seafloor adjacent to a well site and used to selectively provide low and/or high flow fluid delivery by use of subsea storage and pressure boosting for low flow fluid needs and low flow fluid needs.

18 Claims, 3 Drawing Sheets

(56) References Cited

U.S. PATENT DOCUMENTS

| | | | | |
|---|---|---|---|---|
| 2012/0175125 | A1* | 7/2012 | Krohn | E21B 33/0355 166/344 |
| 2014/0112803 | A1* | 4/2014 | Hallset | E21B 41/0007 417/53 |
| 2017/0014874 | A1* | 1/2017 | Turner | B08B 9/0325 |

* cited by examiner

DUAL METHOD SUBSEA CHEMICAL DELIVERY AND PRESSURE BOOSTING

RELATION TO OTHER APPLICATIONS

This application claims the benefit of U.S. Provisional Patent Application 62/315,417 titled "Dual Method Subsea Chemical Delivery and Pressure Boosting" filed on Mar. 30, 2016.

FIELD OF THE INVENTION

Subsea oil and gas production wells typically require chemical treatment to help ensure the reservoir, production tubing, valves and pipelines remain in optimum condition for well flow and pressure integrity. Chemicals are typically delivered to the production wells thru an umbilical from the host facility to which the production is routed. Current methods require the chemicals to be stored and pressurized at the production host to a pressure exceeding that of the shut in pressure of the reservoir in one case and above flowing pressure of the reservoir in another. Exceeding the production pressure ensures the chemicals are delivered into the wellbore and pipeline system to commingle with the production flow. High pressure chemical delivery requires the delivery conduits in the control umbilical to be rated for these high pressures to both meet the injection pressure requirements locally at the wellsite. Often they are required to be rated for higher pressures to overcome the frictional loss while flowing the chemicals over great distances from the host facility to the subsea well location. Each production reservoir is somewhat unique and requires a variety of chemicals and volumes to be delivered to keep the flow conduits in optimum condition. Corrosion, scale, paraffin, emulsifiers and others are a few of the chemicals used in relatively small volumes to treat the production flow. Some chemicals such as methanol, LDHI, monoethylene glycol are typically delivered in higher volumes to treat the production flow and inhibit the formation of hydrates in the production stream.

Often time flow requirements vary over the course of operating the subsea wells. During startup and shutdown of the wells, higher dosage rates and volumes of these hydrate inhibitors are used to prepare the wells for the flowing and stagnant conditions respectively. Once the wells are flowing and their temperatures are stabilized, the flow rates can sometimes be reduced. Intermittent high rates and volumes of the hydrate inhibitors can drive line sizing in the umbilical to accommodate the worst case scenarios often resulting in an over capacity system design for normal flowing conditions. Many projects suffer an undue economic challenge with large diameter, highly corrosion resistant steel specification, umbilical manufacturing costs as a result. Depending on the overall system level chemical requirements, some umbilicals also exceed total volume and weight requirements of the majority of the available vessels needed to install the umbilical, resulting in further additional costs.

FIGURES

The figures supplied herein illustrate various embodiments of the invention.

DESCRIPTION OF VARIOUS EMBODIMENTS

In its various embodiments, the disclosed invention removes chemical delivery conduits from an umbilical, and in some instances eliminates all fluid conduits from the umbilical, and requires only electrical power and/or data delivery to a well site.

In embodiments, subsea fluid storage reservoirs are located on a seafloor adjacent to the well site for low fluid flow requirement chemicals necessary for the well. A subsea pumping system is typically included for boosting the chemical pressure from ambient to that required for injection into the production stream.

In embodiments, low and high flow chemical delivery systems are segregated by use of subsea storage and pressure boosting for the low flow needs and a dedicated flowline from the host facility for the high flow needs. Subsea pressure boosting for the high fluid flow requirements can also be provided for allowing a low pressure flowline to be utilized and minimize cost. The modular approach offered by embodiments of the invention accommodates chemical storage and pumping systems expansion and modification.

In embodiments, integrating the controls and monitoring of both the dual method fluid delivery system and the other subsea production system elements can simplify an umbilical system from a host facility.

Figure 1:
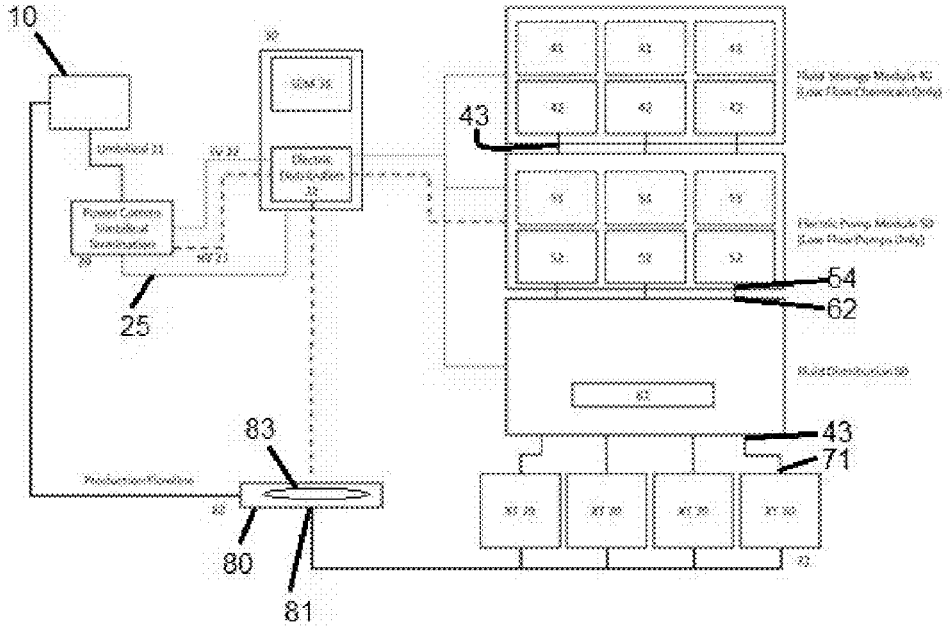
FIG. 1 is a block diagram of a first exemplary embodiment of the claimed invention describing the low flow system.

Referring to FIG. 1, in a first embodiment a modular subsea chemical injection system comprises one or more power and communication umbilical termination modules 20 operatively connected to one or more power and communications umbilicals 21, at least one power and communications umbilical 21 lacking a chemical delivery conduit; at least one power and communications umbilical terminator 29 (not shown in the figures) operatively connected to umbilical 21; one or more power and communications foundation modules 30; one or more fluid storage modules 40 operatively in communication with subsea electronics module 31 and electrical power distributor 32; one or more pump modules 50 operatively in communication with subsea electronics module 31 and electrical power distributor 32; and fluid distribution unit 60.

Host facility 10 may be operatively connected to power and communications umbilical 21.

In contemplated embodiments, subsea control module (SCM) 70 may be present, as more fully described below, where SCM 70 may further comprise SCM fluid port 72.

Power and communication umbilical termination module 20 comprises electrical power port 24 (not shown in the figures) which may comprise low voltage power outlet 22, high voltage power outlet 23, or the like, or a combination thereof. Power and communications umbilical termination module 20 may further comprise data communications port 25. If SCM 70 is present, power and communications termination module 20 typically further comprises non-integral SCM power and data communications port 25 operatively in communication with SCM 70.

At least one power and communications foundation module 30 comprises subsea electronics module 31 operatively in communication with power and communications umbilical terminator data communications port 25 and electrical power distributor 32 operatively in communication with power and communications umbilical terminator electrical power port 24. If SCM 70 is present, power and communications foundation module 30 may further comprise integral SCM power and data communications port 35 operatively in communication with SCM 70.

Fluid storage modules 40 typically comprise a plurality of fluid storage bays 41, each fluid storage bay 41 adapted to selectively receive a corresponding plurality of fluid storage tanks 42, and at least one fluid storage module fluid port 43 in fluid communication with one or more fluid storage tank 42. Not all fluid storage bays 41 need to be populated at any given time.

Pump module 50 typically comprises a plurality of pump bays 51 adapted to selectively receive a corresponding plurality of pumps 52, although not all pump bays 51 need to be populated at any given time. At least one pump 52 is in fluid communication with at least one fluid storage tank 42. In addition, pump module 50 further comprises one or more pump module fluid ports 54 in fluid communication with at least one pump 52. In embodiments, one or more high flow fluid ports 53 may be present in fluid communication with at least one pump 52.

Fluid distribution unit 60 typically comprises at least one distribution fluid port 62 in fluid communication with at least one pump module fluid port 54, at least one fluid distribution unit fluid supply port 63 in fluid communication with distribution fluid port 62, and fluid metering valve 61 disposed intermediate distribution fluid port 62 and fluid distribution unit fluid supply port 63. If one or more subsea control modules (SCM) 70 are present, each SCM 70 is typically in fluid communication with fluid distribution unit fluid supply port 63 such as via port 71. In embodiments, each SCM 70 is in fluid communication with a separate fluid distribution unit fluid supply port 63.

In contemplated embodiments, subsea processing system 80 may be present and in fluid communication with fluid distribution unit fluid supply port 63 and/or SCM fluid port 72 such as via subsea processing system fluid inlet port 81. Subsea processing system 80 may further comprise fluid delivery booster 83 which may be in fluid communication with subsea processing system fluid inlet port 81. If host facility 10 is present, subsea processing system 80 may further comprise at least one subsea processing system fluid outlet port 82 in fluid communication with host facility 10 and, if fluid delivery booster 83 is present, with fluid delivery booster 83.

Figure 2:
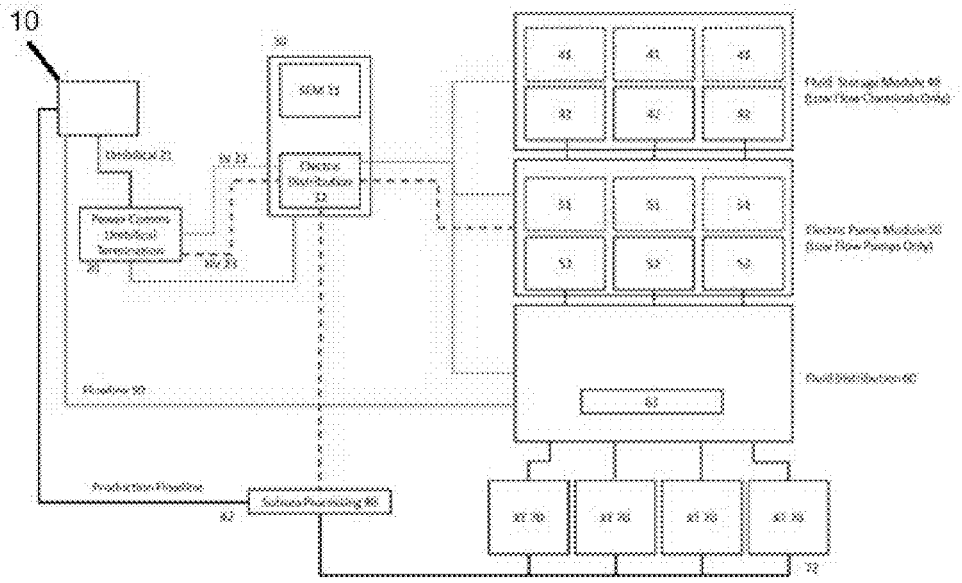
FIG. 2 is a block diagram of a second exemplary embodiment of the claimed invention describing the high flow startup chemical delivery system wherein a flowline is utilized to deliver startup chemicals at pressure and flow.

Referring to FIG. 2, in a second embodiment a modular subsea chemical injection system comprises one or more power and communication communication umbilical termination modules 20 operatively connected to one or more power and communications umbilicals 21, at least one power and communications umbilical 21 lacking a chemical delivery conduit; at least one power and communications umbilical terminator 29 (not shown in the figures) operatively connected to umbilical 21; one or more power and communications foundation modules 30; one or more fluid storage modules 40 operatively in communication with subsea electronics module 31 and electrical power distributor 32; one or more pump modules 50 operatively in communication with subsea electronics module 31 and electrical power distributor 32; and fluid distribution unit 60.

Host facility 10 may be operatively connected to power and communications umbilical 21.

In contemplated embodiments, subsea control module (SCM) 70 may be present, as more fully described below, where SCM 70 may further comprise SCM fluid port 72.

Power and communication umbilical termination module 20 comprises electrical power port 24 (not shown in the figures) which may comprise low voltage power outlet 22, high voltage power outlet 23, or the like, or a combination thereof. Power and communications umbilical termination module 20 may further comprise data communications port 25. If SCM 70 is present, power and communications umbilical termination module 20 typically further comprises non-integral SCM power and data communications port 25 operatively in communication with SCM 70.

At least one power and communications foundation module 30 comprises subsea electronics module 31 operatively in communication with power and communications umbilical terminator data communications port 25 and electrical power distributor 32 operatively in communication with power and communications umbilical terminator electrical power port 24. If SCM 70 is present, power and communications module 30 may further comprise integral SCM power and data communications port 35 operatively in communication with SCM 70.

Fluid storage modules 40 typically comprise a plurality of fluid storage bays 41, each fluid storage bay 41 adapted to selectively receive a corresponding plurality of fluid storage tanks 42, and at least one fluid storage module fluid port 43 in fluid communication with one or more fluid storage tank 42. Not all fluid storage bays 41 need to be populated at any given time.

Pump module 50 typically comprises a plurality of pump bays 51 adapted to selectively receive a corresponding plurality of pumps 52, although not all pump bays 51 need to be populated at any given time. At least one pump 52 is in fluid communication with at least one fluid storage tank 42. In addition, pump module 50 further comprises one or more pump module fluid ports 54 in fluid communication with at least one pump 52. In embodiments, one or more high flow fluid ports 53 may be present in fluid communication with at least one pump 52.

Fluid distribution unit 60 typically comprises at least one distribution fluid port 62 in fluid communication with at least one pump module fluid port 54, at least one fluid distribution unit fluid supply port 63 in fluid communication with distribution fluid port 62, and fluid metering valve 61 disposed intermediate distribution fluid port 62 and fluid distribution unit fluid supply port 63. If one or more subsea control modules (SCM) 70 are present, each SCM 70 is typically in fluid communication with fluid distribution unit fluid supply port 63 such as via port 71. In embodiments, each SCM 70 is in fluid communication with a separate fluid distribution unit fluid supply port 63.

In contemplated embodiments, subsea processing system 80 may be present and in fluid communication with fluid distribution unit fluid supply port 63 and/or SCM fluid port 72 such as via subsea processing system fluid inlet port 81. Subsea processing system 80 may further comprise fluid delivery booster 83 which may be in fluid communication with subsea processing system fluid inlet port 81. If host facility 10 is present, subsea processing system 80 may further comprise at least one subsea processing system fluid outlet port 82 in fluid communication with host facility 10 and, if fluid delivery booster 83 is present, with fluid delivery booster 83.

In contemplated embodiments, a single standalone flowline 90 (which can be composite, carbon steel, stainless, or the like, or a combination thereof) is connected from surface host 10 to subsea fluid distribution unit 60. Chemical startup fluid is pressurized via surface host 10 and delivered at the required flow rate to fluid distribution unit 60.

Figure 3:
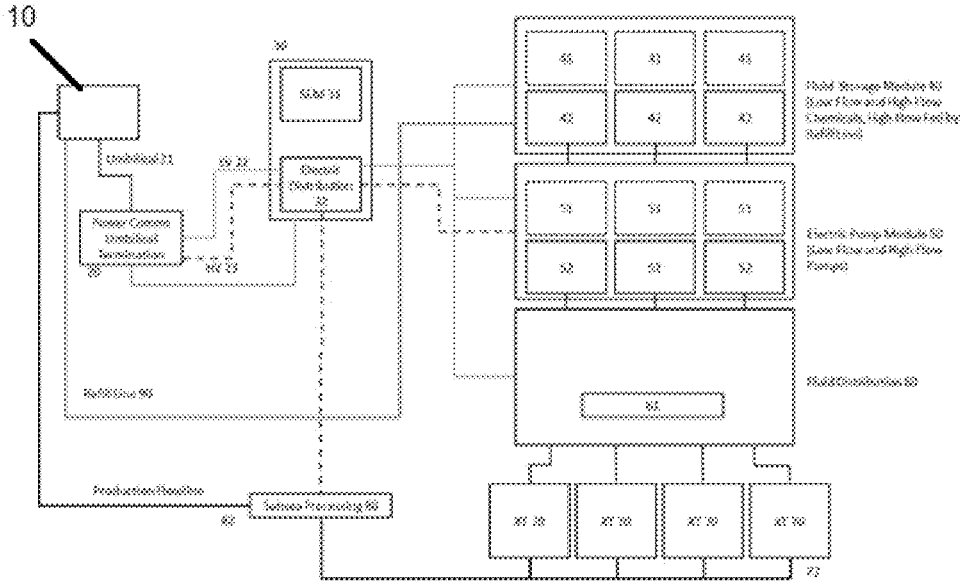
FIG. 3 is a block diagram of a third exemplary embodiment of the claimed invention describing the high flow system wherein a flowline is utilized to deliver startup chemicals at low pressure and flow to refill a series of subsea tanks and where a subsea high flow pump is utilized to deliver startup chemicals at pressure and flow.

Referring to FIG. 3, in a third embodiment a modular subsea chemical injection system comprises one or more power and communication communication umbilical termination modules 20 operatively connected to one or more power and communications umbilicals 21, at least one power and communications umbilical 21 lacking a chemical delivery conduit; at least one power and communications umbilical terminator 29 (not shown in the figures) operatively connected to umbilical 21; one or more power and communications foundation modules 30; one or more fluid storage modules 40 operatively in communication with subsea electronics module 31 and electrical power distributor 32; one or more pump modules 50 operatively in communication with subsea electronics module 31 and electrical power distributor 32; and fluid distribution unit 60.

Host facility 10 may be operatively connected to power and communications umbilical 21.

In contemplated embodiments, subsea control module (SCM) 70 may be present, as more fully described below, where SCM 70 may further comprise SCM fluid port 72.

Power and communication umbilical termination module 20 comprises electrical power port 24 (not shown in the figures) which may comprise low voltage power outlet 22, high voltage power outlet 23, or the like, or a combination thereof. Power and communications umbilical termination module 20 may further comprise data communications port 25. If SCM 70 is present, power and communications umbilical termination module 20 typically further comprises non-integral SCM power and data communications port 25 operatively in communication with SCM 70.

At least one power and communications foundation module 30 comprises subsea electronics module 31 operatively in communication with power and communications umbilical terminator data communications port 25 and electrical power distributor 32 operatively in communication with power and communications umbilical terminator electrical power port 24. If SCM 70 is present, power and communications module 30 may further comprise integral SCM power and data communications port 35 operatively in communication with SCM 70.

Fluid storage modules 40 typically comprise a plurality of fluid storage bays 41, each fluid storage bay 41 adapted to selectively receive a corresponding plurality of fluid storage tanks 42, and at least one fluid storage module fluid port 43 in fluid communication with one or more fluid storage tank 42. Not all fluid storage bays 41 need to be populated at any given time.

Pump module 50 typically comprises a plurality of pump bays 51 adapted to selectively receive a corresponding plurality of pumps 52, although not all pump bays 51 need to be populated at any given time. At least one pump 52 is in fluid communication with at least one fluid storage tank 42. In addition, pump module 50 further comprises one or more pump module fluid ports 54 in fluid communication with at least one pump 52. In embodiments, one or more high flow fluid ports 53 may be present in fluid communication with at least one pump 52.

Fluid distribution unit 60 typically comprises at least one distribution fluid port 62 in fluid communication with at least one pump module fluid port 54, at least one fluid distribution unit fluid supply port 63 in fluid communication with distribution fluid port 62, and fluid metering valve 61 disposed intermediate distribution fluid port 62 and fluid distribution unit fluid supply port 63. If one or more subsea control modules (SCM) 70 are present, each SCM 70 is typically in fluid communication with fluid distribution unit fluid supply port 63 such as via port 71. In embodiments, each SCM 70 is in fluid communication with a separate fluid distribution unit fluid supply port 63.

In contemplated embodiments, subsea processing system 80 may be present and in fluid communication with fluid distribution unit fluid supply port 63 and/or SCM fluid port 72 such as via subsea processing system fluid inlet port 81. Subsea processing system 80 may further comprise fluid delivery booster 83 which may be in fluid communication with subsea processing system fluid inlet port 81. If host facility 10 is present, subsea processing system 80 may further comprise at least one subsea processing system fluid outlet port 82 in fluid communication with host facility 10 and, if fluid delivery booster 83 is present, with fluid delivery booster 83.

In contemplated embodiments, a single standalone flowline 90 (which can be composite, carbon steel, stainless, or the like, or a combination thereof) is connected from surface host 10 to fluid storage module 40.

Single flowline 90 is comprised of low pressure capability designed to aid in refilling fluid storage tanks housing startup chemicals.

Figure 4:
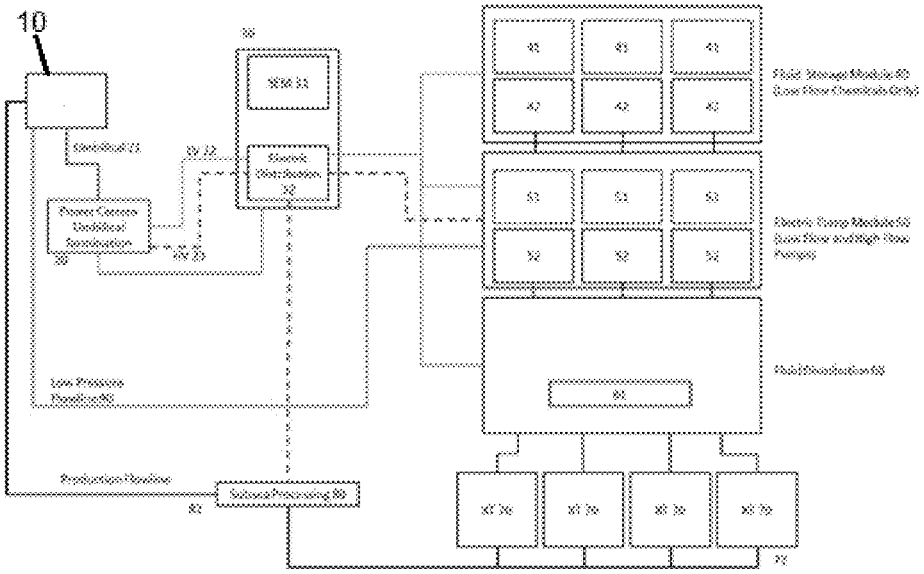
FIG. 4 is a block diagram of a fourth exemplary embodiment of the claimed invention describing the high flow system wherein a flowline is utilized to deliver startup chemicals at low pressure and flow to a subsea high flow pump wherein the chemical supply is boosted via the pump.

Referring to FIG. 4, in a further embodiment a modular subsea chemical injection system comprises one or more power and communication communication umbilical termination modules 20 operatively connected to one or more power and communications umbilicals 21, at least one power and communications umbilical 21 lacking a chemical delivery conduit; at least one power and communications umbilical terminator 29 (not shown in the figures) operatively connected to umbilical 21; one or more power and communications foundation modules 30; one or more fluid storage modules 40 operatively in communication with subsea electronics module 31 and electrical power distributor 32; one or more pump modules 50 operatively in communication with subsea electronics module 31 and electrical power distributor 32; and fluid distribution unit 60.

Host facility 10 may be operatively connected to power and communications umbilical 21.

In contemplated embodiments, subsea control module (SCM) 70 may be present, as more fully described below, where SCM 70 may further comprise SCM fluid port 72.

Power and communication umbilical termination module 20 comprises electrical power port 24 (not shown in the figures) which may comprise low voltage power outlet 22, high voltage power outlet 23, or the like, or a combination thereof. Power and communications umbilical termination module 20 may further comprise data communications port 25. If SCM 70 is present, power and communications terminator 20 typically further comprises non-integral SCM power and data communications port 25 operatively in communication with SCM 70.

At least one power and communications foundation module 30 comprises subsea electronics module 31 operatively in communication with power and communications umbilical terminator data communications port 25 and electrical power distributor 32 operatively in communication with power and communications umbilical terminator electrical power port 24. If SCM 70 is present, power and communications module 30 may further comprise integral SCM power and data communications port 35 operatively in communication with SCM 70.

Fluid storage modules 40 typically comprise a plurality of fluid storage bays 41, where each fluid storage bay 41 is adapted to selectively receive a corresponding plurality of fluid storage tanks 42, and at least one fluid storage module fluid port 43 in fluid communication with one or more fluid storage tank 42. Not all fluid storage bays 41 need to be populated at any given time.

Pump module 50 typically comprises a plurality of pump bays 51 adapted to selectively receive a corresponding plurality of pumps 52, although not all pump bays 51 need to be populated at any given time. At least one pump 52 is in fluid communication with at least one fluid storage tank 42. In addition, pump module 50 further comprises one or more pump module fluid ports 54 in fluid communication with at least one pump 52. In embodiments, one or more high flow fluid ports 53 may be present in fluid communication with at least one pump 52.

Fluid distribution unit 60 typically comprises at least one distribution fluid port 62 in fluid communication with at least one pump module fluid port 54, at least one fluid distribution unit fluid supply port 63 in fluid communication with distribution fluid port 62, and fluid metering valve 61 disposed intermediate distribution fluid port 62 and fluid distribution unit fluid supply port 63. If one or more subsea control modules (SCM) 70 are present, each SCM 70 is typically in fluid communication with fluid distribution unit fluid supply port 63 such as via port 71. In embodiments, each SCM 70 is in fluid communication with a separate fluid distribution unit fluid supply port 63.

In contemplated embodiments, subsea processing system 80 may be present and in fluid communication with fluid distribution unit fluid supply port 63 and/or SCM fluid port 72 such as via subsea processing system fluid inlet port 81. Subsea processing system 80 may further comprise fluid delivery booster 83 which may be in fluid communication with subsea processing system fluid inlet port 81. If host facility 10 is present, subsea processing system 80 may further comprise at least one subsea processing system fluid outlet port 82 in fluid communication with host facility 10 and, if fluid delivery booster 83 is present, with fluid delivery booster 83.

In contemplated embodiments, a single standalone flowline 90 (which can be composite, carbon steel, stainless, or the like, or a combination thereof) is connected from surface host 10 to electric pump module 50.

Single flowline 90 is comprised of low pressure capability designed to deliver required chemical startup flowrates higher than required but at low pressure.

Single or multiple pumps 52 take the low pressure supply from the flowline 90 and boost the to the required injection pressure.

Startup chemicals are delivered via the pumps 52 to the port 62 to the fluid distribution unit 60 to service the wells during startup and shutdown.

Each pump 52 is typically configured to be self-contained and isolatable from the remaining pumps 52 of the predetermined set of individual pumps 52 and to be selectively removable from the bays 51. Moreover, each pump 52 typically comprises storage tank 42, low flow fluid pump 52 in fluid communication with storage tank 42, and fluid pump controller in communication with umbilical 21. Each of storage tank 42, low flow fluid pump 52, and fluid pump controller 1103 may be scalable. Storage tank 42 may comprise a multi-fluid storage tank. In such configurations, multi-fluid storage tank 42 may further comprise a multi-fluid storage tank which is refillable or replacable subsea.

One or more pumps 52 may further comprise a pump designed to deliver fluid to multiple wells distributed via subsea manifold.

Each pump 52 is typically configured to be selectively removable from housing 42 such as via a remotely operated vehicle (ROV), an autonomous underwater vehicle (AUV), a crane assist, or the like, or a combination thereof.

Pump module 52 typically comprises pump module housing comprising a plurality of pump receivers pump fluid inlet in fluid communication with modular subsea chemical injection skid pump fluid outlet a predetermined set of low flow fluid pumps, each low flow fluid pump configured to be received into a pump receiver of the plurality of pump receivers; and fluid pump controller in communication with umbilical signal conduit. Each low flow fluid pump is typically in fluid communication with pump fluid inlet and pump fluid outlet. High flow chemical flowline may be present and in fluid communication with pump module.

Figure 5:
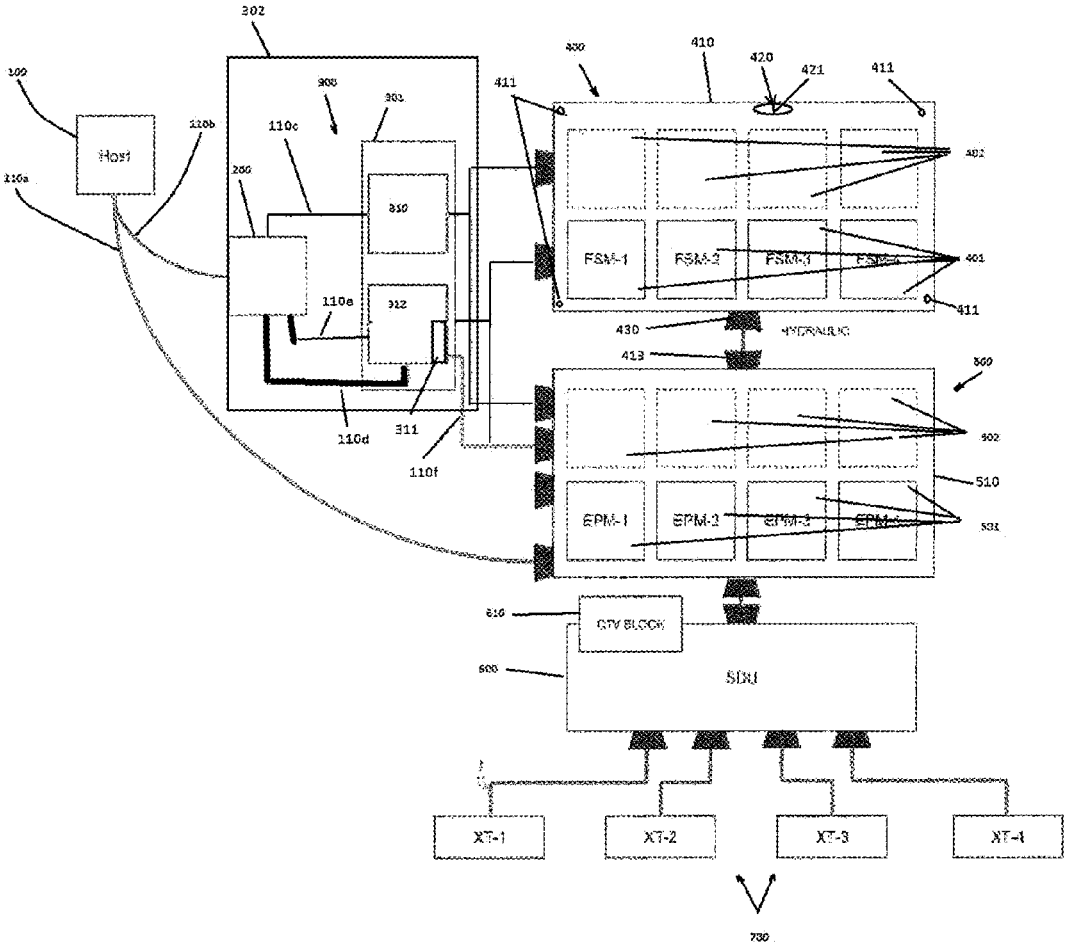
FIG. 5 is a block diagram of a further exemplary embodiment of the claimed invention.

In further contemplated embodiments, referring generally to FIG. 5 a system for delivering fluids subsea comprises umbilical termination assembly 200 designed to break out power cable or electrical umbilical into motive power source, communication pathway which may be bidirectional to provide both feedback to surface location and/or to receive commands/data from surface location, and low voltage power source to supply low voltage to the field.

Modular electric/power distribution module 300 designed to be retrievable and comprises subsea electronics housing 301. In embodiments, electric/power distribution module 300 comprises subsea transformer 310 to step down voltage to usable motive power levels for and distribute electrical signals to the various other modules.

Switchgear 310 is housed in subsea electronics housing 301 and configured for control and protection of electrical components.

Distribution panels/equipment 311 is housed in subsea electronics housing 301 and usable to deliver signals and power to other various modules.

Mudmat 302 is sized to contain and support numerous electrical components. Mudmat 302 is typically sized to contain and support numerous pump modules and may comprise additional slots for expansion if needed.

Subsea electronics module 300 is designed to control components and data exchange throughout predetermined components of the system for delivering fluids subsea and typically comprises controls for automatic fail safe state should a loss of power, communications, and/or controls occur. It also typically receives and collects data/information from all individual modules within the system such as system pressure, valve position, cycle counter, RPM, flow rate, linear position, stroke rate, chemical leak detect, water detection, ground fault monitoring, voltage, and/or current. In embodiments, subsea electronics module 31 receives commands such as via a topside communication link and relays controls and commands to appropriate modules. In certain embodiments the system for delivering fluids subsea may comprise one or more redundant and/or secondary communication links.

Modular fluid storage module 400 is configured to contain a variety of fluids utilized in subsea production activities and comprises frame 410 designed to be delivered and retrieved subsea.

Frame 410 may be locked in place via locking pins 411. One or more indicators 412 may be present to aid in confirm positioning of modular fluid storage module 400. Frame 410 typically comprises ROV interface 420 which comprises one or more subsea interconnects 421 for a predetermined set of connections, by way of example and not limitation comprising low voltage power, data communications, hydraulic connections for suction and discharge, stab plate and connector connectors, instrument and visual indicators designed to relay information topside about the condition of the system, leak detection, and/or level indication. In addition, module 430, which comprises control valves, may be used to isolate the system for delivering fluids subsea via topside communication or manually via an ROV.

A predetermined number of storage modules 402 are disposed within frame 410 and utilized for storage of low flow fluids. Over pressure relief device 413 may be present and disposed within a hydraulic circuit and usable to provide system relief due to under pressure within the hydraulic circuit.

One or more chemical tanks 401 may be removably disposed in storage modules 402, each of which may comprise a bladder is designed to be a form of secondary containment Electric pump module 500 is utilized for delivery of flow assurance chemicals via subsea stored chemicals or boosting for high flow line, and comprises one or more pumps 501, which may comprise a positive displacement pump modified for subsea use, removably disposed in pump storage 500. Pumps 501 are typically disposed within frame 510 and sized to distribute low flow, high pressure inhibitor type chemicals to a multitude of wells or sized to deliver low flow, high pressure inhibitor type chemicals to a single well. In certain embodiments, a single motor drives a single pump or a series of pump. Pump 501 may be rated for metering or dosing. Flow rate can be adjusted via a VFD or a metering valve. As with other modules, electric pump module 500 may comprise an adjustable device for the regulation of system pressure, one or more devices for system relief of over pressure within the hydraulic circuit, and/or one or more a devices for system relief due to under pressure within the hydraulic circuit.

Components of electric pump module 500 are typically housed in frame 510 which is designed to be delivered and retrieved subsea. Frame 510 may be locked in place via locking pins and comprise indicator to aid in confirming position. Frame 510 may further comprise an ROV interface with subsea interconnects for low voltage power, data communications, motive power, hydraulic connections for suction and discharge, and/or stab plate and connector connections. Electric pump module 500 components may be protected via subsea compensation and may further comprise one or more control valves which can isolate system via topside communication or manually via an ROV.

In the operation of exemplary embodiments, the overall cost from both a manufacturing and installation perspective of fluids subsea may be minimized by using one or more of the disclosed systems and providing umbilical 21 that lacks a chemical delivery conduit; locating a subsea fluid storage reservoir such as 40 on a seafloor adjacent to a well site, where subsea fluid storage reservoir 40 is configured to provide low flow requirement fluids necessary for the well; and segregating low and high flow chemical delivery systems by use of subsea storage and pressure boosting for the low flow needs and a dedicated flowline from the host facility for the high flow needs.

In embodiments, all fluid conduits may be eliminated from umbilical 21 and only electrical power needs to be delivered to the well site. In those embodiments with boosters, fluid pressure may be boosted subsea from the subsea storage reservoir for high flow chemical requirements such as boosting the chemical fluid pressure from ambient to that required for injection into the production stream. In certain embodiments, a low pressure flowline may be utilized to minimize cost.

As used herein, a "host" can be defined as a floating deepwater production facility, a permanently fixed structure, an unmanned floating control buoy, or the like.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. A method to minimize the overall cost from both a manufacturing and installation perspective for modular subsea chemical injection system comprising a power and communications umbilical termination module to be operatively connected to an umbilical that lacks a chemical delivery conduit, a power and communications umbilical terminator to be operatively connected to the umbilical where the power and communications umbilical terminator comprises a data communications port and an electrical power port, a power and communications foundation module comprising a subsea electronics module operatively in communication with the power and communications umbilical terminator data communications port and further comprising an electrical power distributor operatively in communication with the power and communications umbilical terminator electrical power port, a fluid storage module operatively in communication with the subsea electronics module and the electrical power distributor and comprising a plurality of fluid storage bays adapted to selectively receive a corresponding plurality of high and/or low flow fluid storage units, a pump module operatively in communication with the subsea electronics module and the electrical power distributor and the fluid storage module and comprising a plurality of pump bays adapted to selectively receive a corresponding plurality of high fluid flow and/or low fluid flow pumps, and a fluid distribution unit in fluid communication with a pump module fluid port, the method comprising:

a. providing the umbilical that lacks a chemical delivery conduit;
b. operatively connecting the umbilical to the power and communications umbilical termination module and the power and communications umbilical terminator;
c. disposing the fluid storage module on a seafloor adjacent to a well site, the fluid storage module configured to selectively provide low fluid flow requirement fluids and high fluid flow requirement fluids for the well; and
d. selectively providing low and high flow fluid delivery by use of subsea storage and pressure boosting for low flow fluid needs and high flow fluid needs.

2. The method of method to minimize the overall cost from both a manufacturing and installation perspective of claim 1, further comprising:

a. providing a dedicated flowline from a host facility to the well; and
b. using the dedicated flowline to provide high flow fluid to the well for high flow needs.

3. The method of method to minimize the overall cost from both a manufacturing and installation perspective of claim 1, further comprising using a pump from the high fluid flow and/or low fluid flow pumps to boost fluid pressure subsea from the fluid storage module for high flow chemical requirements.

4. The method of method to minimize the overall cost from both a manufacturing and installation perspective of claim 3, further comprising allowing a low pressure flowline to supply a fluid whose fluid pressure is to be boosted by the pump.

5. The method of method to minimize the overall cost from both a manufacturing and installation perspective of claim 1, further comprising boosting fluid flow pressure from ambient to that required for injection into a production stream.

6. A modular subsea chemical injection system, comprising:

a. a power and communications umbilical termination module configured to be operatively connected to an umbilical that lacks a chemical delivery conduit;

b. a power and communications umbilical terminator configured to be operatively connected to the umbilical, the power and communications umbilical terminator comprising a data communications port and an electrical power port;

c. a power and communications foundation module, comprising:

i. a subsea electronics module operatively in communication with the power and communications umbilical terminator data communications port; and ii. an electrical power distributor operatively in communication with the power and communications umbilical terminator electrical power port;

d. a fluid storage module operatively in communication with the subsea electronics module and the electrical power distributor, the fluid storage module comprising:

i. a plurality of fluid storage bays adapted to selectively receive a corresponding plurality of high fluid flow and/or low fluid flow fluid storage units; and ii. a fluid storage module fluid port in fluid communication with the plurality of high fluid flow and/or low fluid flow fluid storage bays;

e. a pump module operatively in communication with the subsea electronics module and the electrical power distributor, the pump module comprising:

i. a plurality of pump bays adapted to selectively receive a corresponding plurality of pumps, at least one pump being in fluid communication with the fluid storage module fluid port;

ii. a fluid port in fluid communication with the plurality of pump bays; and iii. a pump module fluid port in fluid communication with the plurality of pump bays; and f. a fluid distribution unit, comprising:

i. a distribution fluid port in fluid communication with the pump module fluid port;

ii. a fluid distribution unit fluid supply port in fluid communication with the distribution fluid port; and iii. a fluid metering valve disposed intermediate the distribution fluid port and the fluid distribution unit fluid supply port.

7. The modular subsea chemical injection system of claim 6, further comprising a subsea control module (SCM) in fluid communication with the fluid distribution unit fluid supply port.

8. The modular subsea chemical injection system of claim 7, wherein the power and communications foundation module further comprises an integral SCM power and data communications port operatively in communication with the SCM.

9. The modular subsea chemical injection system of claim 7, wherein the power and communications umbilical termination module further comprises a non-integral SCM power and data communications port operatively in communication with the SCM.

10. The modular subsea chemical injection system of claim 6, further comprising a subsea processing system, the subsea processing system further comprising:

a. a subsea processing system fluid inlet port in fluid communication with the fluid distribution unit fluid supply port;

b. a subsea processing system fluid outlet port; and c. a fluid delivery booster in fluid communication with the subsea processing system fluid inlet port and the subsea processing system fluid outlet port.

11. The modular subsea chemical injection system of claim 10, further comprising a subsea control module (SCM) comprising a distribution port in fluid communication with the fluid distribution unit fluid supply port and an SCM fluid port in fluid communication with the subsea processing system fluid inlet port.

12. The modular subsea chemical injection system of claim 10, further comprising a host facility operatively connected to the power and communications umbilical, the host facility in fluid communication with the subsea processing system fluid outlet port.

13. The modular subsea chemical injection system of claim 6, wherein the power and communication umbilical termination module comprises a low voltage power outlet and a high voltage power outlet.

14. The modular subsea chemical injection system of claim 6, wherein the fluid port comprises a high flow fluid port in fluid communication with the plurality of pump bays.

15. The modular subsea chemical injection system of claim 6, wherein:

a. the pump module comprises a low fluid flow pump or a high fluid flow pump; and b. the fluid storage module comprises a low fluid flow fluid storage unit or a high fluid flow fluid storage unit.

16. A modular subsea chemical injection system, comprising:

a. a housing;

b. a predetermined set of individual low fluid flow injector assemblies removably disposed at least partially within the housing and configured to be operatively in communication with an umbilical signal conduit, each individual low fluid flow injector assembly configured to be self-contained and isolatable from the remaining individual low fluid flow injector assemblies and to be selectively removable from the housing, each individual low fluid flow injector assembly comprising:

i. a low fluid flow injector;

ii. a storage tank in fluid communication with the low fluid flow injector;

iii. a fluid pump in fluid communication with the storage tank; and iv. a fluid pump controller in communication with the umbilical signal conduit and the fluid pump;

c. a predetermined set of individual high flow injector assemblies removably disposed at least partially within the housing and configured to be operatively in communication with the umbilical signal conduit, each individual high fluid flow injector assembly configured to be self-contained and isolatable from the remaining high fluid flow injectors and the predetermined set of individual low fluid flow injector assemblies, each individual high fluid flow injector assembly selectively removable from the housing, each individual high fluid flow injector assembly comprising:

i. a high fluid flow injector;

ii. a storage tank in fluid communication with the high fluid flow injector;

iii. a high fluid flow pump in fluid communication with the storage tank and with the high fluid flow injector; and iv. a fluid pump controller in communication with the umbilical signal conduit and the high fluid flow pump; and d. a flow meter in fluid communication with the predetermined set of individual low fluid flow injectors.

17. The modular subsea chemical injection system of claim 16, further comprising a high fluid flow chemical flowline in fluid communication with a high flow individual injector assembly of the predetermined set of individual high flow injector assemblies, the high fluid flow chemical flowline sized to ensure adequate suction is available to prevent pump cavitation of the high fluid flow pump of the high flow individual injector assembly.

18. The modular subsea chemical injection system of claim 16, wherein the umbilical further comprises an umbilical comprising the signal conduit and lacking a functional chemical delivery fluid conduit.

* * * * *